United States Patent [19]

Meyer

[11] Patent Number: 4,998,734

[45] Date of Patent: Mar. 12, 1991

[54] GOLF BALL

[75] Inventor: David P. Meyer, Glendale, Ariz.

[73] Assignee: Universal Golf Supply, Inc., Phoenix, Ariz.

[21] Appl. No.: 444,016

[22] Filed: Nov. 30, 1989

[51] Int. Cl.[5] ..... A63B 37/12

[52] U.S. Cl. ..... 273/235 R; 273/213; 40/327

[58] Field of Search ..... 40/327; 273/235 R, 213, 273/183 C, 235 A, 235 B, 233, 234

[56] References Cited

U.S. PATENT DOCUMENTS

| | | | |
|---|---|---|---|
| 1,622,421 | 3/1927 | Coffield | 273/213 |
| 2,600,856 | 6/1952 | Decepoli | 40/327 |
| 4,798,386 | 1/1989 | Berard | 273/235 R |

*Primary Examiner*—George J. Marlo

*Attorney, Agent, or Firm*—David G. Rosenbaum

[57] ABSTRACT

An improved golf ball wherein an indicia-bearing layer is interdisposed between the core and a transparent or translucent cover material.

12 Claims, 1 Drawing Sheet

GOLF BALL

BACKGROUND OF THE INVENTION

The present invention relates generally to golf balls and, in particular, to golf balls having a transparent or translucent covering and bearing textual, alphanumeric, or graphic indicia visible through the transparent or translucent covering.

Golf balls have traditionally been made by bonding a cover about a resilient core. The cover is either compression molded from two half shells or is injection molded about the resilient core. Until about the mid-1960's, most golf ball covers were usually made of balata, a natural resin. However, since that time a golf ball cover material made of a synthetic resin sold under the trademark SURLYN by E. I. DuPont de Nemours has captured the vast majority of the market.

Today, golf balls are typically made with a cover material molded about a core, as mentioned, with the core consisting either of a wound core or a solid core. Irrespective of the golf ball construction or the composition of the cover, it is customary in the art to apply a finish to the surface of the golf ball cover. The finishing process is an elaborate, complicated and highly developed process. A customary painting operation involves sandblasting the surface of the cover, washing, drying, and then in successive steps, applying a primer, drying the primer, applying a first white coat, drying the first coat, applying a second white coat, drying the second white coat, stamping a trademark and numbers, and then finishing with a clear finish coat. Despite the elaborate manufacturing process, some manufacturers still have some wearing of the paint surface, especially after extensive use of the ball. In many cases, the wearing can become so extensive or acute as to obliterate the trademark or identifying numeral rendering identification of a player's particular ball difficult, if not impossible.

Numerous ball configurations are known in the art which attempt to display some type of indicia on the ball in a manner which is protected from wear. For example, in 1925, U.S. Pat. No. 1,547,339 disclosed that it is known to sew some type of indicia, such as names, initials, advertisement, or trade devices onto the cover of the ball prior to manufacture of the ball. Use of the threaded indicia was long lasting and did not easily wear. Obviously, threaded messages are impractical in a golf ball type arrangement. Alternatively, in U.S. Pat. No. 1,436,028, issued in 1922, it was disclosed that it is known to incorporate some type of graphic design in a homogenous structure used to make rubber playing balls. In this patent, a fabric design is applied to the article while the rubber is in an unvulcanized condition, and during vulcanization the fabric becomes embedded in the surface and integrally united therewith. While this may be utilized as a means for marking the resilient cores of golf balls, it only adds to the complexity and expense of the manufacturing process and is not, therefore, desirable for use in golf ball manufacturing. Recently, U.S. Pat. No. 4,798,386 disclosed that it is advantageous to stamp identifying indicia directly on the core such that it can be seen through a transparent fluorescent material used to cover the core. This patent acknowledges that by providing the identifying indicia directly on the core and underneath the fluorescent transparent cover, a long lasting and relatively permanent retention of a trademark and identification number or other markings put on the ball is achieved. This patent, however, teaches that the identifying indicia must be stamped directly onto the golf ball core. The direct stamping method disclosed by this patent, however, is prone to the ordinary difficulties associated with printing on a curvilinear surface, namely higher rates of errors in the printing process through incomplete transfer of the image onto the round surface.

Accordingly, a need has been recognized to provide a new type of golf ball which utilizes and employs an indicia-bearing layer interdisposed between the core and the cover of the ball, the cover being transparent or translucent to permit viewing of the indicia through the golf ball cover.

SUMMARY OF THE INVENTION

It is a broad object of the present invention, therefore, to provide a golf ball which employs a solid core, a layer bearing textual, alphanumeric, or graphical indicia and a transparent or translucent cover material which is, in turn, covered with an appropriate high gloss and transparent lacquer. The indicia-bearing liner may consist of any thin layer of plastic or paper material which is sufficiently thin to permit substantial transference of impact forces from the cover to the core without substantially reducing the transferred force. Examples of plastic material suitable to be used with the present invention are Mylar, cellophane, or other sufficiently resilient plastic material such as paint, latex, etc.. Any type of thin paper material, such as currency, and other thin weight papers, or fabrics, may also be employed.

These and other features and advantages of the present invention will be better understood from the following more detailed description of the preferred embodiments with reference to the accompanying drawings.

BEST MODE FOR CARRYING OUT THE INVENTION

Figure 1:
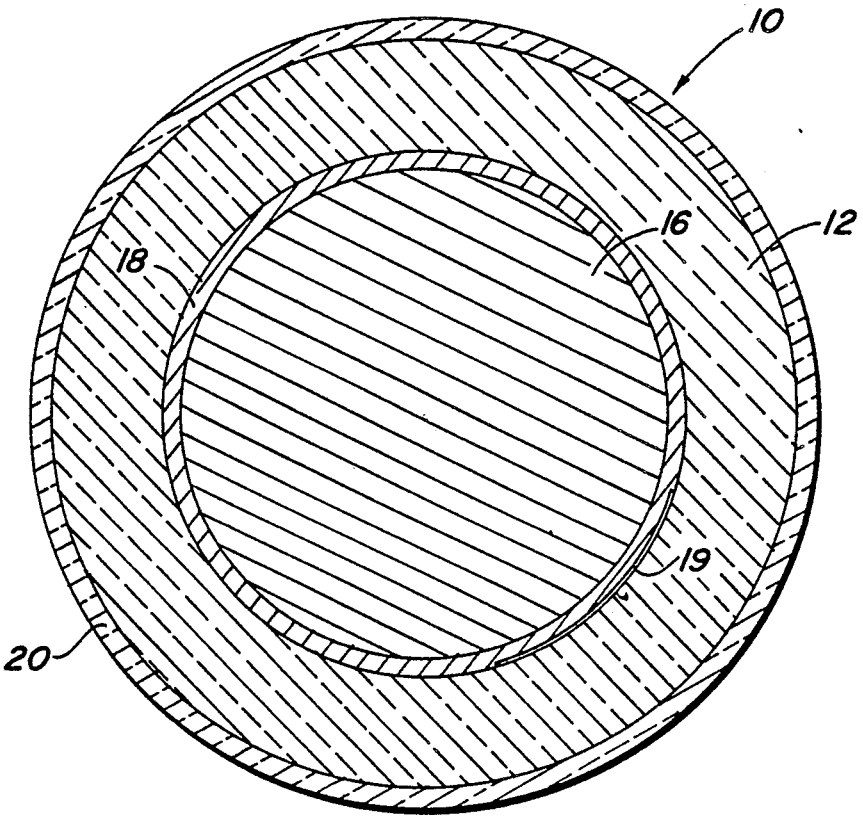
FIG. 1 is a cross-sectional view of a golf ball in accordance with the present invention having a solid core, an indicia-bearing layer disposed thereon, a transparent cover and a transparent coating on top of the cover.

Turning to FIG. 1, there is shown a golf ball 10 having a transparent cover provided about a solid core 16. As is known in the art, the cover 12 may contain any type of dye so long as the cover is transparent or translucent. Disposed entirely about the core 16 is a layer 18 bearing indicia 19, which is visible through the transparent or translucent cover 12. The indicia-bearing layer can either entirely or partially surround the core.

In accordance with the preferred embodiment of the present invention in the best mode of the invention, the core should be a solid core to ensure optimum contact between the indicia-bearing layer 18 and the core. However, those skilled in the art will understand and appreciate that a wound core may be substituted, but that the flight dynamics of the ball may be affected. On top of the cover 14 is disposed a transparent coating 20 which gives the golf ball its shiny appearance.

The indicia-bearing layer may be formed of two half spheres of a suitable material having printing or other design thereupon or therein which are welded about the core. Alternatively, the indicia-bearing layer 18 may consist of a flat plastic material wound about the core and heat shrunk thereupon. Still again, the indicia-bearing layer may consist of a plastic, fabric or paper material wound about the core in suitable manner. Those skilled in the art will understand and appreciate that the claims appended hereto cover all changes and modifications to the preferred embodiment of the invention disclosed herein for the purpose of illustration which do not constitute departures from the scope and spirit of the invention.

What is claimed is:

1. A golf ball comprising a core and a transparent cover, and a layer interdisposed therebetween and enclosing at least a substantial portion of said core said layer including a portion thereof indicia for identification of said golf ball.

2. The golf ball of claim 1, wherein said indicia-bearing layer further comprises a plastic material.

3. The golf ball according to claim 1, wherein said indicia-bearing layer further comprises a paper material.

4. The golf ball according to claim 1, wherein said indicia-bearing layer further comprises a fabric material.

5. The golf ball according to claim 1, wherein said core is a solid core.

6. The golf ball according to claim 1, wherein said core is a wound core.

7. A golf ball comprising a core, a resilient member substantially enclosing said core, a substantially transparent cover disposed about said resilient member and indicia on a portion of said member for identification of said golf ball.

8. The golf ball of claim 7, wherein said indicia-bearing layer further comprises a plastic material.

9. The golf ball according to claim 7, wherein said indicia-bearing layer further comprises a paper material.

10. The golf ball according to claim 7, wherein said indicia-bearing layer further comprises a fabric material.

11. The golf ball according to claim 7, wherein said core is a solid core.

12. The golf ball according to claim 7, wherein said core is a wound core.

* * * * *

UNITED STATES PATENT AND TRADEMARK OFFICE

CERTIFICATE OF CORRECTION

PATENT NO. : 4,998,734

DATED : March 12, 1991

INVENTOR(S) : David P. Meyer

It is certified that error appears in the above-identified patent and that said Letters Patent is hereby corrected as shown below:

Column 3, line 11, insert --,-- after the word "core".

Column 3, line 12, insert --on-- after the word "including".

Signed and Sealed this

Twenty-fifth Day of August, 1992

*Attest:*

DOUGLAS B. COMER

*Attesting Officer*

*Acting Commissioner of Patents and Trademarks*